United States Patent [19]

Rued

[11] 4,368,805

[45] Jan. 18, 1983

[54] HYDRAULIC CONTROL UNIT FOR ELEVATORS

[75] Inventor: Glen A. Rued, Montrose, Calif.

[73] Assignee: Elevator Equipment Company, Los Angeles, Calif.

[21] Appl. No.: 216,130

[22] Filed: Dec. 15, 1980

[51] Int. Cl.[3] ..... B66B 11/04

[52] U.S. Cl. ..... 187/17; 137/881; 91/449

[58] Field of Search ..... 187/17, 24, 29 A; 251/133, 208; 137/881, 879; 91/449, 361

[56] References Cited

U.S. PATENT DOCUMENTS

| | | | |
|---|---|---|---|
| 3,136,328 | 6/1964 | Hipp | 137/881 |
| 3,141,386 | 7/1964 | Loughridge | 91/361 |
| 3,710,824 | 1/1973 | Lohbauer | 137/881 |

*Primary Examiner*—Stanley H. Tollberg
*Assistant Examiner*—Kenneth Noland

[57] ABSTRACT

A control unit for a hydraulic actuated elevator consists of a valve device in the hydraulic circuit wherein the circuit includes a pump, a hydraulic cylinder and its piston for raising and lowering an elevator cab and a reservoir for the hydraulic fluid. The valve device features a rotary disc serving as a valve element slidable to positions which open and close ports leading respectively to the reservoir and the cylinder. A reversible electric motor in a cab demand circuit has a rotary drive to the rotary disc, as, for example, by a pinion and gear, for rotating the rotary disc in response to the cab demand circuit serving to start and stop the motor. In one position of the rotary disc, with both ports closed, hydraulic fluid is passed directly into the cylinder for up travel of the cab. In an intermediate position with the port to the cylinder closed the fluid is locked in the cylinder in stop position of the cab. In a third position with both ports open fluid flows from the cylinder to the reservoir, bypassing the pump, for down travel of the cab.

22 Claims, 6 Drawing Figures

Fig. 4.
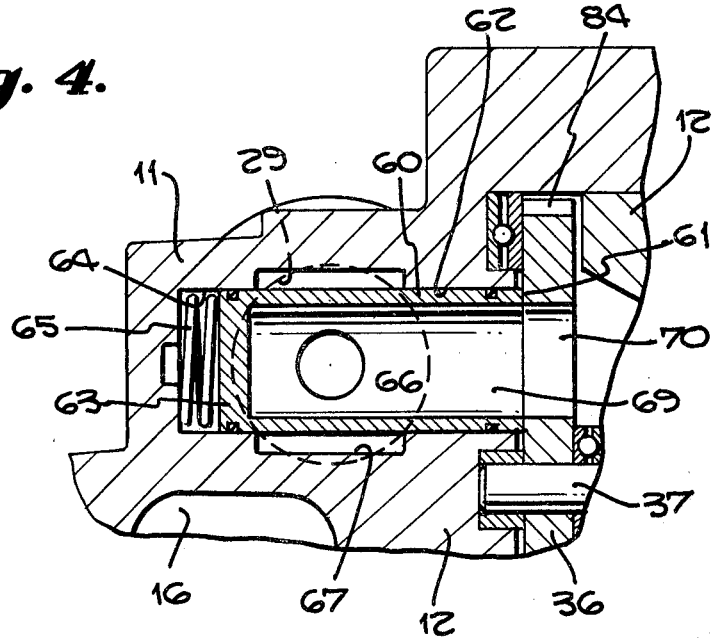
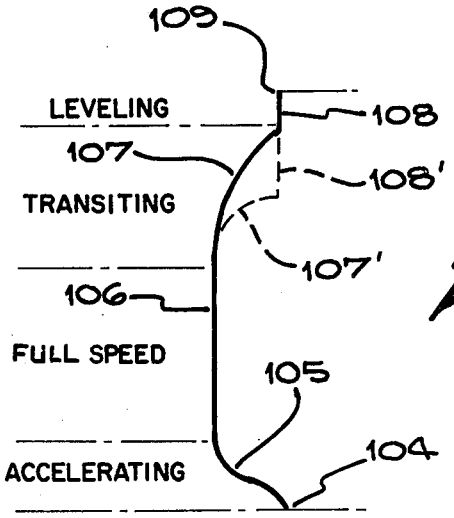
Fig. 6.
Fig. 5.
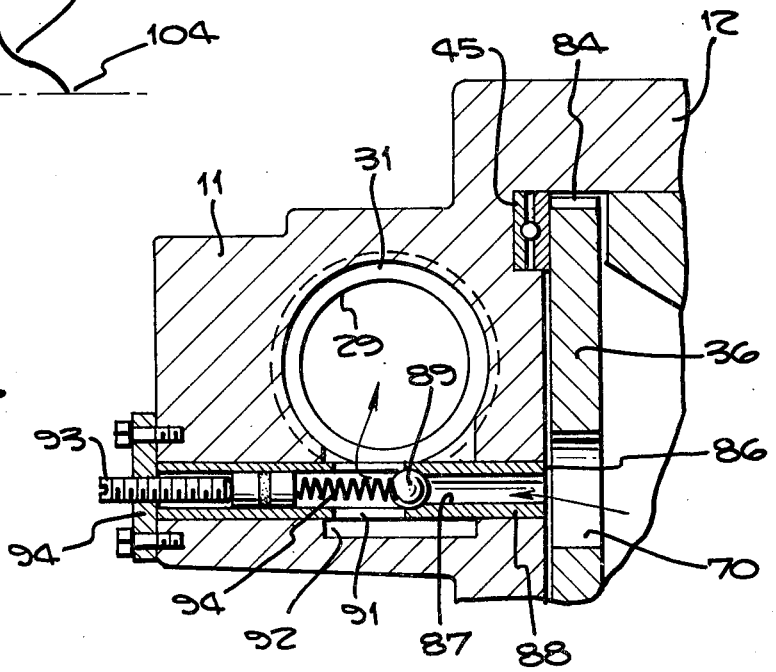

HYDRAULIC CONTROL UNIT FOR ELEVATORS

Attention is directed to copending application Ser. No. 127,767, filed Mar. 6, 1980, now U.S. Pat. No. 4,345,507, and copending application Ser. No. 167,388, filed July 9, 1980 now U.S. Pat. No. 4,311,212.

The invention herein, being directed to valving for hydraulic elevators, is one operated in a field where a number of directly related characteristics need to be taken into consideration. Hydraulic fluid which is depended on and which may be selected for some particular installation may vary appreciably from others as to specific gravity and viscosity. These factors affect the flow of hydraulic fluid through the system and its valving. Temperatures changes have a considerable effect upon the flow of hydraulic fluid, especially in sections of the country which experience high temperature fluctuations, sometimes throughout the year, and even relatively wide fluctuations throughout the day. As a consequence, the hydraulic fluid, when flowing through valves and controls in cold condition, performs in a manner different from the same fluid flowing through such valves and controls in heated condition. Some hydraulic fluids are more greatly affected by temperature changes than others. The result of such fluctuations are frequently such that although a system may be timed in a perfectly acceptable manner for one condition, it may be appreciably out of time for a different condition.

Another factor influencing the performance of hydraulic elevators is that of variations in load. This is true whether the elevator may be used as a passenger elevator, or as a freight elevator, or both. When a load of consequence is placed in the cab of an elevator, there is an immediate change in pressure present in the hydraulic circuit. For lifting the elevator cab and its load, pressure must be applied by the system, and the need for pressure consequently varies with the load.

Since in the functioning of a hydraulic elevator there is constant need for the hydraulic fluid to pass through orifices in the valving, the rate at which the hydraulic fluid will pass through such valving under high pressure will vary appreciably with differences in pressure. Such changes appreciably affect the performance of the elevator cab, especially when, during up travel, for example, the cab approaches a floor level to which it is called. Normally when an elevator is called from one floor to another, initial movement is one of acceleration until full speed is reached. The cab then travels the greater portion of the distance from one floor to another at full speed but before reaching the floor to which it is called, the speed must diminish progressively to a point immediately adjacent the floor where, at minimum speed, the cab approaches the floor and stops. The usual result of a heavy increase of load on the cab is to cause the slow-down speed to occur much further away from the floor which the cab is approaching followed by travel at minimum speed for an appreciably longer time. The result is an overall slow-down in operation.

Comparable variations are also experienced in the decelerating phase of the cycle. It clearly follows that there will be a change in speed of operation for any added load, the change varying, therefore, with different loads, unless some compensating provision is made for such changes in the hydraulic circuit.

Another factor influencing the selection of controls for the hydraulic circuit is the prospect of encountering in the field different practices with regard to the pressure used. One practice is to employ a high volume flow as opposed to a second practice using low volume flow at a higher pressure.

Furthermore, when valves and controls depend upon small orifices for adjustment as, for example, needle valves, there is always the prospect of dirt and sediment in the system impairing the proper operation of those portions of the system. Since uninterrupted performance of hydraulic systems is expected over long periods of time, interruptions made necessary by the servicing of circuits having such limitations or the malfunctioning of complex valves and regulators becomes a serious problem.

It is therefore among the objects of the invention to provide a new and improved hydraulic control unit for hydraulic elevators of a relatively simple design and construction such that the number of parts can be held substantially to a minimum and to minimize as well the number and variety of moving parts for handling the flow of hydraulic fluid at different positions of adjustment.

Another object of the invention is to provide a new and improved hydraulic control unit for hydraulic elevators capable of being readily adapted to the handling of hydraulic fluid at different prevailing pressures and rates of flow without material change in basic structure.

Another object of the invention is to provide a new and improved hydraulic control unit with an improved positive operating cycle of a high degree of sensitivity but which at the same time is consistent in its performance under different operating conditions.

Still another object of the invention is to provide a new and improved hydraulic control unit wherein a change in adjustment from one mode to another is accomplished by linear movement of a relatively flat surface, customarily in an arcuate path, wherein the movement is responsive to the output torque of a reversible motor, the motor being subject to an electric cab demand circuit.

Still further among the objects of the invention is to provide a new and improved hydraulic control unit for hydraulic elevators which is of such design and construction as to accommodate itself to appreciable fluctuations in the hydraulic fluid which is handled either in the form of pressure changes resulting from changes in load or viscosity variations resulting from changes in temperature, the unit being capable of compensating for those changes to assure continued acceptable performance without need for readjustment.

Also included among the objects of the invention is to provide such a new and improved hydraulic control unit as is capable of fail-safe operation should there be a discontinuance of power for any reason.

With these and other objects in view, the invention consists of the construction, arrangement, and combination of the various parts of the device, serving as an example only of one or more embodiments of the invention, whereby the objects contemplated are attained, as hereinafter disclosed in the specification and drawings, and pointed out in the appended claims.

FIG. 4 is a fragmentary sectional view on the line 4—4 of FIG. 2.

FIG. 5 is a fragmentary sectional view on the line 5—5 of FIG. 2.

FIG. 6 is a graph showing the various phases of travel of a cab in the up-travel mode.

Figure 1:
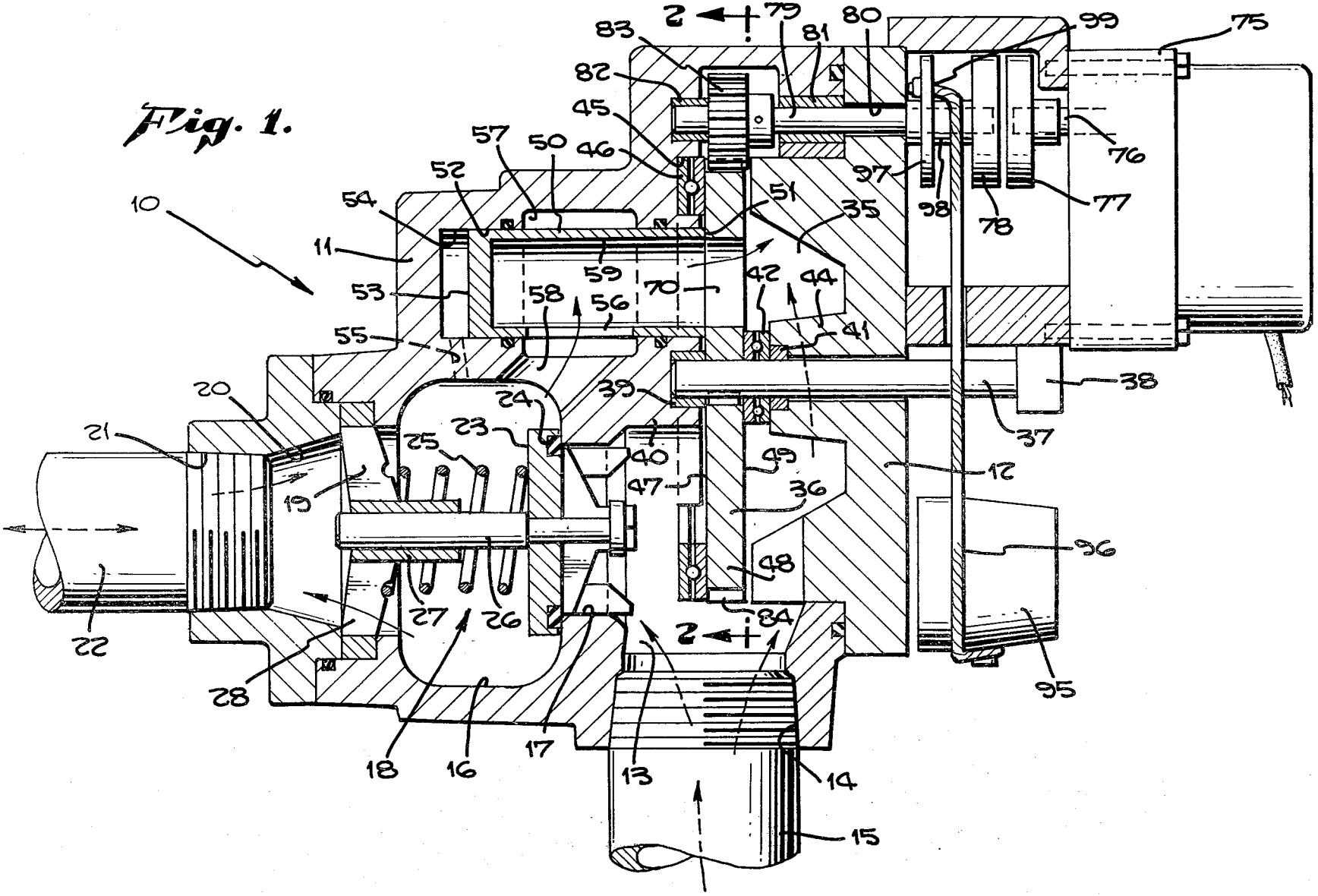
FIG. 1 is a longitudinal sectional view of the hydraulic elevator control unit taken along the line 1—1 of FIG. 2.
Figure 2:
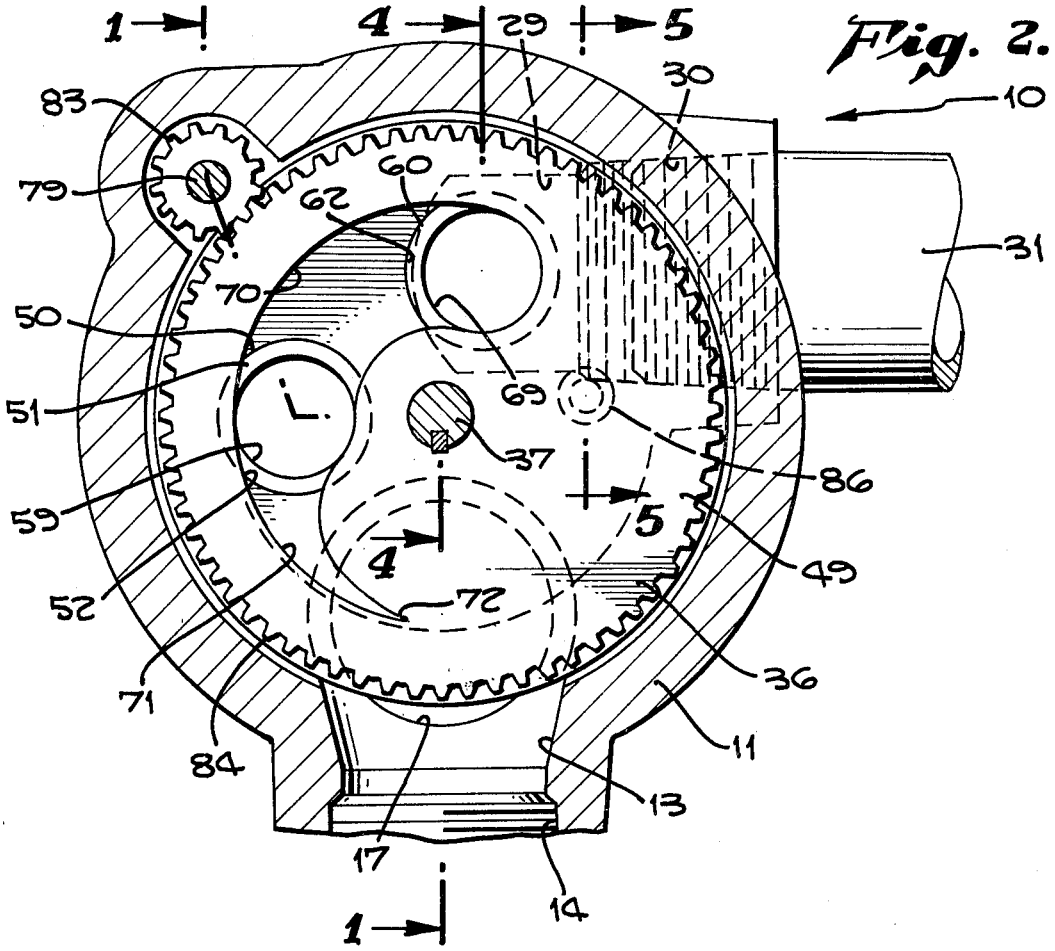
FIG. 2 is a cross-sectional view of the control unit on the line 2—2 of FIG. 1 showing one position of the valve unit.
Figure 3:
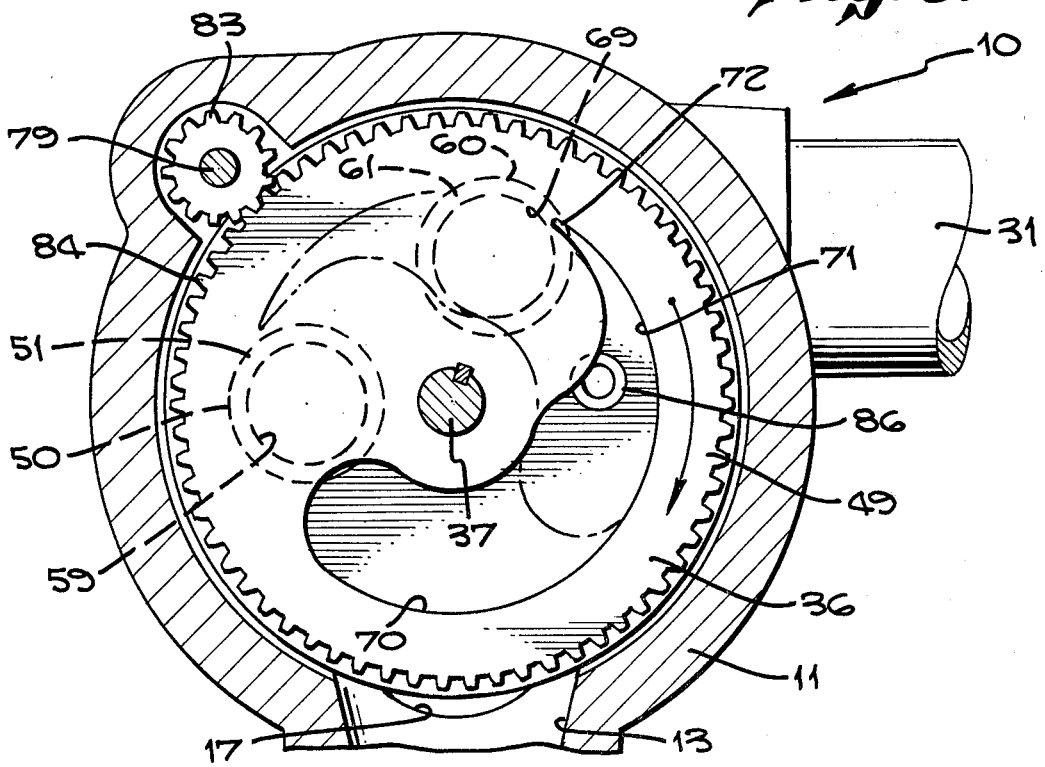
FIG. 3 is a cross-sectional view similar to FIG. 2, but showing the valve unit in another position.

In an embodiment of the invention chosen for the purpose of illustration, the hydraulic elevator control unit is shown in assembled form in FIG. 1 in a position of adjustment for down travel of an elevator cab. FIG. 2 shows the position of valve operating parts in the same attitude for down travel of the elevator cab. FIG. 3 shows the position of valve operating parts for up travel of the cab.

A housing, indicated generally by the reference character 10, is made use of which, in the chosen embodiment, consists of a main body 11, on the left of FIG. 1, to which is attached a cover 12, attachment being by conventional means not shown. The main body is cast in a form providing an inflow passage 13 with a pump connection 14 for the accommodation of a pipe line 15 from a pump (not shown). To the left of the inflow passage 13 is a chamber 16 interconnected with the inflow passage by a passageway 17 in which, in the chosen embodiment, there may be positioned a check valve assembly 18. In communication with the chamber 16 through a passageway 19 is an inflow-outflow passage 20 served by a jack connection 21 for a pipe line 22 adapted to connect with the power cylinder (not shown) of a conventional hydraulic elevator jack.

In the chosen embodiment the check valve assembly comprises a check valve element 23 adapted to seat upon an annular valve seat 24 so as to open with respect to flow from the inflow passage 13 to the inflow-outflow passage 20, and to close, assisted by pressure of a spring 25, in the opposite direction. A valve stem 26 is guided by a bushing 27 in a spider 28.

Return flow of hydraulic fluid to a conventional reservoir (not shown) is best traced in FIG. 2 in which a fluid return flow passage 29, in broken lines, communicates with a return flow connection 30. A return pipe 31 is adapted to return fluid to a conventional hydraulic reservoir (not shown).

In the cover 12, as shown in FIG. 1, is an auxiliary passage means 35, which may be referred to as a bypass passage in that it can accept the fluid flow from the inflow passage 13 directly, in that way to bypass the hydraulic jack for return of hydraulic fluid through the return flow passage 29 to the reservoir.

Immediately adjacent and to the left of the auxiliary passage means 35, as shown in FIG. 1, is an elevator cab direction controller which, in the chosen embodiment, is embodied in a rotary disc serving as a valve closure member. The rotary disc is keyed to a shaft 37 mounted for rotation at the right end, as viewed in FIG. 1, in a bearing 38. The shaft 37 is journalled at the left end in a bearing 39 supported by an integral portion 40 of the main body 11. For sealing the auxiliary passage means, use is made of an annular seal 41. Surrounding the shaft 37, and adjacent thereto is a roller bearing cage 42 separating the rotary disc 36 from a mount 44. A second roller bearing cage 45 acts between a bearing recess 46 in the main body 11 and one face 47 of the rotary disc 36 adjacent an arcuate perimeter 48. On the rotary disc is an opposite parallel face 49, the rotary disc being located between the opposite spaced parallel faces 47 and 49.

In cooperation with the rotary disc 36 is what may aptly be designed as down travel insert 50, shown to the left of the rotary disc as a FIG. 1. The insert is in effect a valve seat element, of hollow cylindrical form presenting at the right-hand edge an annular valve seat 51. The valve seat 51 acts with the face 47 of the rotor disc 46 with a slidable approach serving together as a valve and valve seat.

The insert 50 is received in a cylindrical recess 52 and has an inner closed end 53 serving to close a pocket 54. The pocket 54 is in communication through a bleed passage 55 with the chamber 16 so that fluid pressure in the chamber 15 is conveyed to the pocket 54 to serve as a resilient cushion, urging the insert into its sliding relationship with he face 47.

In the wall of the insert 50 is an opening 56 in communication with an annular recess 57, which in turn is in communication through a communicating opening 58 with the chamber 16. A central valve passage 59 extends through the insert 50. bearing recess 46 in the main body 11 and one face 47 of the rotary disc 36 adjacent an arcuate perimeter 48. On the rotary disc is an opposite parallel face 49, the rotary disc being located beween the opposite spaced parallel faces 47 and 49.

In cooperation with the rotary disc 36 is what may apty be designated as down travel insert 50, shown to the left of the rotary disc as a FIG. 1. The insert is in effect a valve seat element, of hollow cylindrial form presenting at the right-hand edge an annular valve seat 51. The valve seat 51 acts with the face 47 of the rotor disc 46 with a slidable approach serving together as a valve and valve seat.

The insert 50 is received in a cylindrical recess 52 and has an inner closed end 53 serving to close a pocket 54. The pocket 54 is in communication through a bleed passage 55 with the chamber 16 so that fluid pressure in the chamber 15 is conveyed to the pocket 54 to serve as a resilient cushion, urging the insert into its sliding relationship with he face 47.

In the wall of the insert 50 is an opening 56 in communication with an annular recess 57, which in turn is in communication through a communicating opening 58 with the chamber 16. A central valve passage 59 extends through the insert 50.

There is a similar return flow or up travel insert 60 providing an annular valve seat 61 similarly reciprocatably mounted in a cylindrical recess 62 of the main body, and spaced a distance circumferentially relative to the location of the down travel insert 50.

As shown in FIG. 4, a closed end 63 of the insert 60 resides in a pocket 64 in which is located a spring 65 adapted to provide resilient action to force the annular valve seat 61 into position against the face 47 of the rotary disc 36.

Extending through the wall of the insert 60 is an opening 66 communicating between a central valve passage 69 and an annular recess 67 and therefrom to the return flow passage 29 to allow fluid to flow back to the fluid supply tank or reservoir.

In order for the rotary disc 36 to serve as the valve closure member with its transversely slidable movement relative to the annular valve seats 51 and 61, there is provided in the rotary disc a substantially arcuate orifice 70. For a substantial proportion of its arcuate length, the orifice has a width approximately equal to the diameter of the central valve passages 59 and 69, those diameters being substantially the same in the chosen embodiment. The orifice extends clear through the rotary disc 36 from one face 47 to the other face 49. The orifice, moreover, is especially formed in that there is provided an approach portion 71 extending from a relatively narrow approach terminal 72, the approach portion being one expanding progressively from the terminal 72 until it achieves the full width of the main portion of the orifice, as appropriately shown in FIGS. 2 and 3.

For driving the rotary disc 36, there is provided a motor 75, which in the chosen embodiment is electrically driven, the motor 75 being mounted on the cover 12 by appropriate conventional connections. Extending from the motor 75 is a drive shaft 76 and clutch element 77 in cooperation with a driven clutch element 78 mounted on a driven shaft 79. The driven shaft passes through an opening 80 in the cover 12 and is appropriately journalled in bearings 81 and 82 in the main body 11. Keyed to the driven shaft 79 is a pinion 83 meshing with a circumferentially arcuate gear or rack 84 on the arcuate circumference of the rotary disc 36. It should be observed that the motor 75 is a reversible motor so designed as to be capable of rotating the rotary disc 36 in either a clockwise or counterclockwise direction, as viewed in FIGS. 2 and 3, for a distance something in excess of 180 degrees, namely, the distance between the position of FIG. 2 and the position of FIG. 3.

As a safety feature there is provided a high pressure relief valve member 86 in the main body which is adapted to communicate between the chamber 16 and the return flow passage 29. In the event there should be an excessive build-up of pressure, either for failure of the pump to discontinue operation or excessive load on the cab, generating excessive pressure in the inflow-outflow passage 20, such pressure can be relieved gradually by the high pressure relief valve member into the return flow passage and from there back to the reservoir. Particulars of the relief valve member are shown in FIG. 5.

A passage 87 through a valve stem 88 is adapted to unseat a ball check 89 against a spring 90 to escape through lateral opening 91 to an annular recess 92 and from there to the return flow passage 29. Tension in the spring 90 may be varied by manipulation of an adjusting screw 93 in a fitting 94.

Fail-safe operation is provided for in the event of power failure at any time. The fail-safe mechanism, in the embodiment chosen by way of example, makes use of a weight 95 attached to a cable 96, the cable in turn being secured to a fail-safe lever 97. The fail-safe lever may be an extension such, for example, as a flange and bushing 98 keyed to the driven shaft 79. The attachment of the cable 96 to the fail-safe lever 97 is at a point 99 radially outwardly from the axis of rotation to the driven shaft 79 and at a circumferential position such that when the rotary disc 36 is in off position, the point 99 is in its lowermost position. As a consequence, rotation of the driven shaft 79 in either direction for any angular distance up to 180 degrees the weight 95 is lifted, whereafter upon release of the rotating torque on the shaft 79, the weight will return the shaft to its initial position and as a consequence return the rotary disc to off position. Although the fail-safe attachment in the chosen embodiment is shown made to the driven shaft 79, it could be as advantageously made to the shaft 37, the end result being to rotate the rotary disc 36 to the desired position.

In operation let it be assumed that the elevator cab is at the first floor, the pump stopped, and the motor 75 deenergized. For this condition the rotary disc 36 is in the position shown in FIG. 3 wherein both of the insert valve seats are closed by engagement of the face 47 of the rotary disc with the respective valve seats. By reason of this, hydraulic fluid in the jack is trapped in that it can neither return to the inflow passage 13 because of seating of the check valve assembly 18 nor pass through the communication opening 58 into the valve passage 59 because the valve seat is closed.

Assume then that the cab is called from a first floor level 104 to a second floor level 109 by activation of the electric cab demand circuit. As a result, the pump is activated to generate flow of hydraulic fluid under pressure into the inflow passage 13. Because, as shown by the broken line position of the arcuate orifice 70 in FIG. 3, the valve seat 51 of the down travel insert 50 is closed, hydraulic fluid flows through the passage 69 and return pipe 31 to the reservoir. When the up signal of the demand circuit energizes the motor 75 the motor causes the rotary disc 36 to rotate clockwise until the arcuate orifice 70 assumes the solid line position of FIG. 3. In such position, the valve seat 61 of the up travel insert 60 is closed, cutting off flow of hydraulic fluid through the passage 69 and back to the reservoir. Because, as shown by the broken line position of the arcuate orifice 70 in FIG. 3, the valve seat 51 of the down travel insert 50 is closed, hydraulic fluid flows through the passage 69 and return pipe 31 to the reservoir. When the up signal of the demand circuit energizes the motor 75, the motor causes the rotary disc 36 to rotate clockwise until the arcuate orifice 70 assumes the solid line position of FIG. 3. In such position, the valve seat 61 of the up travel insert 60 is closed, cutting off flow of the hydraulic fluid through the passage 69 and back to the reservoir. Therefore, because both valve seats now remain closed, hydraulic fluid unseats the check valve assembly 18 and flows through the inflow-outflow passage 20 and the pipe line 22 to the hydraulic jack, putting the cab into an up-travel mode. As shown in FIG. 6 phases experienced by the up-travel mode are initially an accelerating phase 105 followed by a full speed phase 106, then a decelerating or transiting phase 107 and finally a levelling phase 108.

As the cab approaches the second floor, the electric motor 75 is energized and rotation of its drive shaft 76, acting through the pinion and gear drive, causes the rotary disc 36 to commence rotating in a counterclockwise direction, as viewed in FIG. 3. Initial rotation moves the approach terminal 72 to a position over the valve passage 69 of the up-travel insert 60, which functions to conduct hydraulic fluid to the return flow passage 29 for travel back to the reservoir. Continued counterclockwise travel of the rotary disc 36 first moves the approach portion 71 of the orifice 70 progressively over the valve passage 69, passing more and more fluid to the return flow passage 29 and at the same time progressively diminishing flow into the chamber 16 which results in a deceleration of up-travel of the cab.

Movement of the rotary disc continues counterclockwise until it assumes the broken line position in FIG. 3. In that position, any continued flow from the pump is entirely bypassed to the return flow passage 29. At the same time, by reason of the fact that the valve seat 51 remains covered by the face 47 of the rotary disc, and pump action discontinued, movement of the cab stops, the hydraulic fluid being trapped in the jack.

Let it be assumed then that there is a call to return the cab to the first floor acting through the cab demand circuit. The call results in energizing the electric motor 75 without actuating the pump, energization of the motor causing continued counterclockwise rotation of the rotary disc 36 from the broken line position of FIG. 3 toward the solid line position of FIG. 2. Initially the approach terminal 72 commences uncovering the valve passage 59 from which hydraulic fluid from the jack commences passing through the central passage 59 to the approach portion 71 of the orifice 70, then the auxiliary passage means 35 and from there into the valve passage 69 of the insert 60 for travel back to the reservoir. Passage of hydraulic fluid in this direction progressively increases as the rotary disc moves further in a counterclockwise direction until it reaches the full open solid line position of FIG. 2 at which the down travel of the cab is at full speed with maximum flow of hydraulic fluid from the central passage 59 into the central passage 69 until the cab is almost returned to the first floor.

At this point, by appropriate action of the cab demand circuit, an appropriate signal is given to the electric motor 75 which is caused to reverse its rotation and again, acting through the pinion and gear, rotates the rotary disc 36 in a clockwise direction, as viewed in FIG. 2. The result of such clockwise rotation is a progressive closing of the central passage 59 as the approach portion 71 is removed from its position over the annular valve seat 51. The progressive cutting off of the flow results in a deceleration of down travel of the cab until the cut-off point is reached which is the broken line position of FIG. 3. At this point the rotary disc can continue its clockwise travel to the solid line position of FIG. 3 or remain in the broken line position pending the next signal from the cab demand circuit.

Because of the sliding action of the face 47 of the rotary disc over the valve seats, which in turn are resiliently pressed into engagement, the entire system being lubricated by the hydraulic fluid, there is a smooth transition from one valve adjustment to another. Also, by reason of the gear and pinion drive for the rotary disc, a well-timed dependable movement can be given to the rotary disc which is in fact a valve element, thereby to exert a control of extra dependability on changes in the valve adjustment for the different positions of travel of the elevator cab. Although a rotary disc serving as a valve element has been shown, the travel is substantially linear and the sliding motion need not be arcuate but could be that of a rectilinear valve element moving in a straight line. Furthermore, precise adjustments can be achieved by the shape and direction of the approach passage coupled with the rate of rotation of the disc without employment of passages of calibrated minimum flow which could be subject to clogging, inasmuch as every time the valving of the invention is in full open position, there is a complete wash-through of hydraulic fluid.

Without the advantages of Applicant's improved control unit extra loading on the cab would distort the up-travel phases, as shown by the broken line transiting phase 107' and longer broken line leveling phase 108'.

While a particular embodiment of the present invention has been shown and described, it will be obvious to those skilled in the art that changes and modifications may be made without departing from the invention in its broader aspects, and therefore, the aim of its appended claims is to cover all such changes and modifications as fall within the true spirit and scope of the invention.

Having described the invention, what is claimed as new in support of Letters Patent is as follows:

1. A hydraulic elevator control unit for operation with an electric cab demand circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements wherein said cab is in upward motion, a second of said positions being one wherein said closure member is operative to open said second valve seat element to said return passage wherein said cab is stationary and a third of said positions being one wherein said closure member is operative to open both said first and second valve seat elements for communication with each other wherein said cab is in downward motion.

2. A hydraulic elevator control unit as in claim 1 wherein there is an auxiliary passage means in said cover means in constant communication with said inflow passage means and potential flow communication with said return flow passage.

3. A hydraulic elevator control unit for operation with an electric cab demand circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements, a second of said positions being one wherein said closure member is operative to open said second valve seat element to said return passage and a third of said positions being one wherein said closure member is operative to open both said first and second valve seat elements for communication with each other and an auxiliary passage means in said cover means having potential flow communication with respectively said bypass passage, said return passage and said inflow passage in successive positions of said valve closure member.

4. A hydraulic elevator control unit as in claim 3 wherein said orifice is in communication with said auxiliary passage when said valve closure member is in the third of said operative positions.

5. A hydraulic elevator control unit for operation with an electric cab demand circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements, a second of said positions being one wherein said closure member is operative to open said second valve seat element to said return passage and a third of said positions being one wherein said closure member is operative to open both said first and second valve seat elements for communication with each other and a motor drive responsive to said cab demand circuit, said motor drive having an operative connection with said valve closure member for shifting said valve closure member to its several operative positions.

6. A hydraulic elevator control unit as in claim 5 wherein said motor drive includes a drive shaft on said housing means and a rack and pinion connection between said drive shaft and said valve closure member.

7. A hydraulic elevator control unit as in claim 6 wherein there is a fail-safe eccentric weight in operating engagement with said drive shaft adapted to return said drive shaft to a position wherein said valve closure member is returned to the first of said positions closing both of said valve seat elements.

8. A hydraulic elevator control unit for operation with an electric cab demand circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements, a second of said positions being one wherein said closure member of said positions being one wherein said closure member is operative to open said second valve seat element to said return passage and a third of said positions being one wherein said closure member is operative to open both said first and second valve seat elements for communication with each other and a check valve between said pump connection and said jack connection operative to open in a direction of flow toward said jack connection.

9. A hydraulic elevator control unit for operation with an electric cab demand circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements, a second of said positions being one wherein said closure member is operative to open said second valve seat element to said return passage and a third of said positions being one wherein said closure member is operative to open both said first and second valve seat elements for communication with each other and yieldable pressure means acting between said housing means and said seat elements operable to hold said valve seat elements in engagement with said valve closure member.

10. A hydraulic elevator control unit as in claim 9 wherein there is a pocket adjacent at least one of the valve seat elements and a bleed passage in communication between said pocket and the inflow passage whereby said pressure means is a hydraulic pressure means.

11. A hydraulic elevator control unit as in claim 9 wherein at least one of the valve seat elements has a spring return means acting between the body and said insert whereby said pressure means is a spring.

12. A hydraulic elevator control unit as in claim 11 wherein each said sleeve has a central passageway and a lateral opening from said passageway for accommodation of fluid passing the valve seat.

13. A hydraulic elevator control unit as in claim 12 wherein there are opposite substantially parallel faces on said rotor element, said orifice being an opening through the rotor element from one face to the other.

14. A hydraulic elevator control unit as in claim 12 wherein there is a single rotor element having an annular perimeter, and a motor drive responsive to said cab demand circuit, said motor drive having an operative connection with the perimeter of said rotor element, said orifice being an arcuately elongated opening through the rotor element with centerlines respectively of a main portion and approach portion of said orifice being on a common radius about the axis of rotation.

15. A hydraulic elevator control unit as in claim 9 wherein each said valve seat element comprises a cylindrical sleeve and a cylindrical pocket in said housing having said sleeve slidably received therein, said sleeve having an annular edge comprising a valve seat for engagement with said valve closure member.

16. A hydraulic elevator control unit for operation with an electric demand circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements, a second of said positions being one wherein said closure member is operative to open said second valve seat element to said return passage and a third of said positions being one wherein said closure member is operative to open both said first and second valve seat elements for communication with each other, said valve closure member comprising at least one rotor element having a rotatable shaft mounting the respective rotor element in said housing, said closure member having an arcuate perimeter.

17. A hydraulic elevator control unit as in claim 16 wherein there is a motor drive responsive to said cab demand circuit, said motor drive having a rotating drive relationship with said rotor element for rotating said rotor element to said plurality of positions.

18. A hydraulic elevator control unit as in claim 17 wherein there is bearing means acting between said housing and the arcuate perimeter of the rotor element.

19. A hydraulic elevator control unit as in claim 18 wherein said orifice has a main portion with a breadth substantially equal to the diameter of one of said valve seat elements, and an approach portion of progressively diminishing breadth extending beyond said main portion.

20. A hydraulic elevator control unit as in claim 16 wherein there is a motor drive responsive to said cab demand circuit, said motor drive having a drive shaft and pinion thereon and a gear on the arcuate perimeter of the rotor element in driven relationship with said pinion.

21. A hydraulic elevator control unit for operation with an electric cab circuit, a reservoir, a pump, a jack consisting of a cylinder and piston, and a cab for movement by said piston, said unit comprising housing means providing an inflow passage and pump connection thereto, an outflow passage and a jack connection thereto, a bypass passage in operating communication with said first two passages, and a return flow passage, cover means for said housing means adapted to enclose said passages, a first valve seat element for said bypass passage and a second valve seat element for said return passage, an elevator cab direction controller comprising a valve closure member having a transversely slidable movement relative to said valve seat elements, said valve closure member having an orifice therein and having a plurality of transversely slidable operative positions, a first of said positions being one wherein said closure member is operative to close both of said valve seat elements, a second of said positions being one wherein said closure member is operative to open said second valve seat element to said return passage and a third of said positions being one wherein said closure member is operative to open both said first and second valve seat elements for communication with each other, said orifice being an opening through said valve closure element and with a breadth at least as great as the diameter of one of said valve seat elements, the length of said orifice being at least as long as the center to center distance between said valve seat elements.

22. A hydraulic elevator control unit as in claim 21 wherein a center line of said main portion is in longitudinal alignment with the center line of said approach portion.

* * * * *